United States Patent [19]

Stricker et al.

[11] 4,228,345

[45] Oct. 14, 1980

[54] TRAVELING INFRARED BELL OVEN SYSTEM

[75] Inventors: Jesse C. Stricker, Fenton; Dennis L. Wagner, Ballwin, both of Mo.

[73] Assignee: Black Body Corporation, St. Louis, Mo.

[21] Appl. No.: 973,894

[22] Filed: Dec. 28, 1978

[51] Int. Cl.[2] ..... F27D 11/03

[52] U.S. Cl. ..... 219/388; 53/557; 219/354; 219/411

[58] Field of Search ..... 432/239, 241; 53/442, 53/557, 556; 156/84–86; 219/243, 10.55, 388, 411, 10.69; 414/147, 152, 157; 34/236, 105

[56] References Cited

U.S. PATENT DOCUMENTS

| | | | |
|---|---|---|---|
| 3,653,177 | 4/1972 | Adams et al. | 53/557 |
| 3,710,550 | 1/1973 | Osborne | 53/557 |
| 3,760,154 | 9/1973 | Konger | 53/557 |
| 3,807,126 | 4/1974 | Schwarz | 53/557 |
| 3,974,353 | 8/1976 | Goltsos | 219/10.55 A |
| 4,146,777 | 3/1979 | Wells et al. | 53/557 |

*Primary Examiner*—B. A. Reynolds
*Assistant Examiner*—Bernard Roskoski
*Attorney, Agent, or Firm*—Kalish & Gilster

[57] ABSTRACT

A traveling oven system is adapted for use synchronously with an extrinsic conveyor, particularly for shrink wrapping purposes by heating an object such as a pallette, package, or other article of manufacture covered by a polyethylene film bag to shrink the bag about the same. The system includes a bell-type oven having a housing with side wall portions, front and rear wall portions, and a top wall, being open at the lower end and having infrared heating panels on predetermined wall portions. The oven is supported above the conveyor by a tram carried by a gantry extending along the conveyor for vertical movement of the oven with respect to the conveyor and also for horizontal movement in forward and reverse directions along a reach of the conveyor. A vertical drive is included for vertically reciprocally moving the oven between an upper position with the lower end of the oven above objects at least partially enclosing such objects for heating thereof. A horizontal drive is provided for horizontally moving the oven in forward and reverse directions. A control circuit causes the horizontal drive to move the oven forward in synchronism with the conveyor while causing the vertical drive to move the oven down to the lower position for heating of such objects and thereafter to move it to the upper position. The control circuit then causes the horizontal drive to move the oven in the reverse direction to turn it to a starting position for heating of further items upon the conveyor.

32 Claims, 13 Drawing Figures

TRAVELING INFRARED BELL OVEN SYSTEM

BACKGROUND AND SUMMARY OF THE INVENTION

The present invention relates to an oven for industrial heating and particularly to an infrared oven utilizable for synchronous heating, and particularly for shrink wrapping purposes, of objects while the same are moving upon a conveyor.

An object of the invention is the provision of an oven system for use in synchronism with an extrinsic conveyor for automatically carrying out heating of successive objects as the same are moving successively upon the conveyor, as on as assembly line, and without requiring supervision or human intervention.

Another object of the invention is the provision of an oven of the character stated having a bell-type oven which is movable, i.e., travels in both horizontal and vertical directions, the oven lowering from an overhead position above the conveyor while moving horizontally in synchronism with a product upon the conveyor to at least partially enclose the moving objects for heating thereof.

A further object of the invention is the provision of an oven of the character stated including infrared heating elements, particularly of the black body panel type, within the oven for infrared heating of objects upon the conveyor without use of forced circulating air and providing such heating in an extraordinarily safe, efficient, and economical manner.

A still further object of the invention is the provision of an oven of the character stated for heating of articles covered with film bags for shrink wrapping purposes by shrinking of such film through infrared heating.

Another object of the invention is the provision of an oven system of the character stated which achieves precise infrared heating of objects moving upon the conveyor regardless of the variations of speed or even stopping of the conveyor.

Another object of the invention is the provision of an oven system of the character stated for heating of the objects moving upon the conveyor for a predetermined period of time regardless of variations of speed or stopping of the conveyor.

Yet another object of the invention is the provision of an oven system of the character stated for automatically causing retarding of the speed of the conveyor if, during heating of the products which are moving upon the conveyor, the required heating for a predetermined period cannot be completed before moving of the products beyond a predetermined distance.

Another object of the invention is the provision of an oven system of the character stated which will automatically adjust the position of the moving oven with regard to objects moving upon the conveyor by variation in the horizontal speed of the conveyor thereby to provide accurate positioning of the oven with regard to such moving objects.

A further object of the invention is the provision of an oven system of the character stated which carries out forward horizontal movement of the oven in syncrhonism with the product moving upon the conveyor regardless of variations of speed of the conveyor but nevertheless returns the oven by accelerated movement horizontally in the reverse direction; a related object being the provision of such feature which also decelerates the oven gently as the oven approaches the starting position.

A still further feature of the invention is the provision of an oven system of the character stated which operates in an intrinsically safe fashion and utilizes safety features for sensing obstructions below the oven to prevent damage to persons, objects to be heated by the oven, or the oven itself during movement of the oven.

Among still other objects of the invention may be noted the provision of an oven system of the character stated achieving accurate, high-speed, efficient, production line compatible heating, and particularly for shrink wrap purposes; the provision of such an oven system achieving heating with automatic temperature control to provide consistent production; and the provision of such an oven system which is rugged, long-lasting, and highly safe and reliable in operation.

DESCRIPTION OF THE PREFERRED EMBODIMENT

Figures 1, 2, 3:
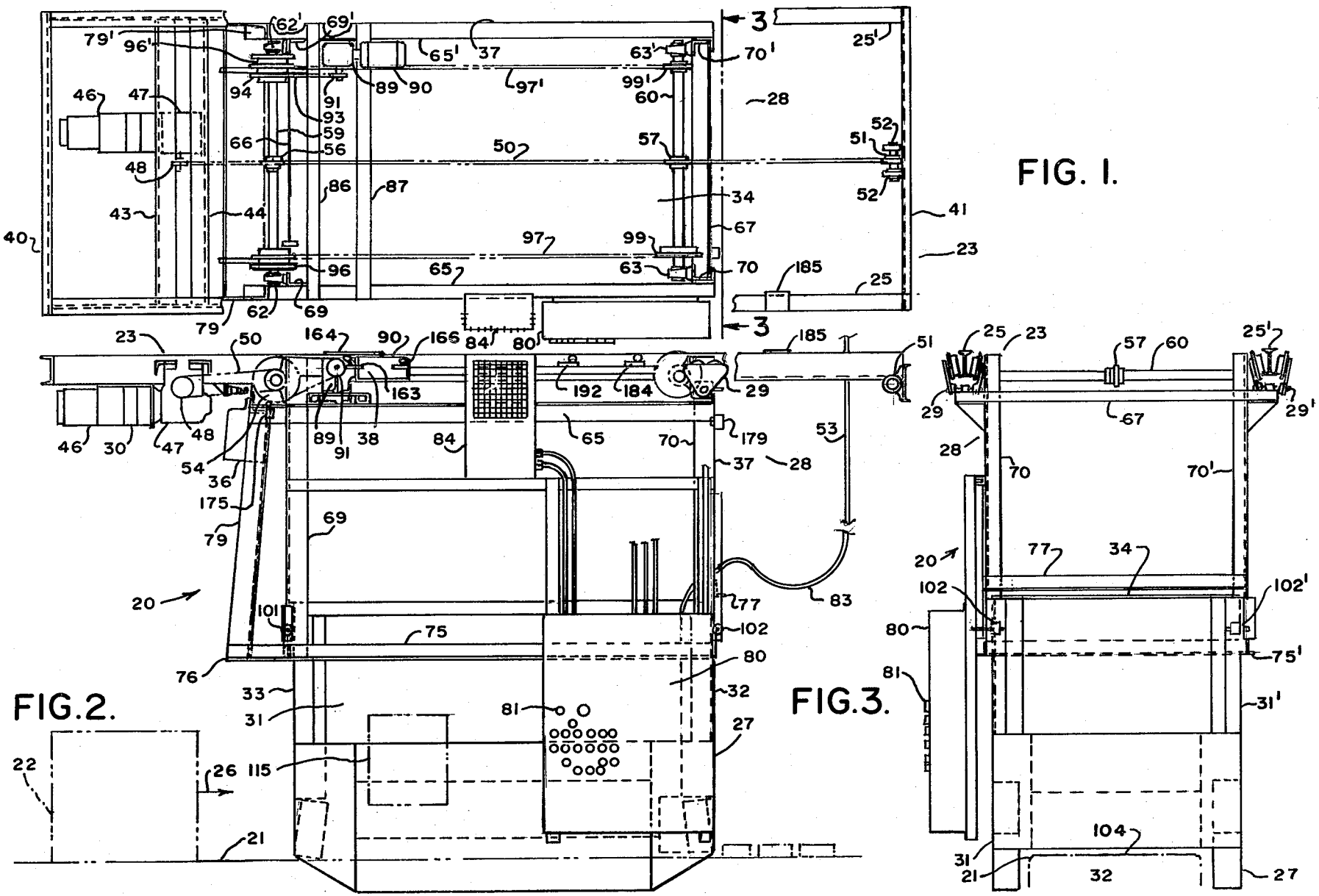
FIG. 1 is a horizontal plan view of an oven system constructed in accordance with and embodying the present invention.
FIG. 2 is a side elevational view of the oven system of FIG. 1.
FIG. 3 is an end elevational view of the new oven system, taken generally along line 3—3 of FIG. 1.

Referring now to the drawings, and particularly to FIGS. 1–3, reference numeral 20 generally indicates an oven system of the present invention which is adapted for synchronous use with an extrinsic moving conveyor 21 for automatically heating of objects, one of which is represented at 22, being moved in succession by conveyor 21. Generally speaking, the oven system involves the provision of a gantry 23 having a parallel spaced apart pair of beams 25,25' and positioned above a reach of conveyor 21 with the gantry being longitudinally aligned with the conveyor, which may be one of any of various types, such as moving belt, rollers, wheeled carts or platforms which move the products 22 in a forward direction indicated by an arrow 26. As will be understood, conveyor 21 may move such products at a speed which may vary dependent upon production line demands or needs, or may periodically be retarded and brought to a halt as a result of interruptions and other factors.

The new oven system further comprises an oven 27 carried by a tram 28 which is suspended from rails 25,25' by roller guides such as that shown at 29,29' of a conventional type which engage the lower flanges of the rails, which preferably are of the I-beam type. Tram 28 is adapted to be powered by an electric drive unit 30 for horizontal movement of the tram 28 and oven 27 in a forward direction along gantry 23 in synchronism with movement of objects, such as that indicated at 22, as they are moving forward. Drive unit 30 also provides movement in the reverse direction for returning tram 28 and oven 27 to a starting position from which a cycle is initiated.

Oven 27 is of an infrared type and so-called bell configuration, the same being open at the bottom and closed by side wall portions 31,31', forward and rear end wall portions 32,33, respectively, and at the top as indicated at 34.

Said oven 27 is suspended from tram 28 by a chain belt arrangement with the weight of the oven counterbalanced by a counterweight 36. The oven 27 is adapted to being reciprocally noved up and down within a frame 37 of tram 28 by operation of an electric drive unit 38 carried by the tram and thereby providing for movement between an upper position, in which the lower end of the oven is spaced above objects on conveyor 21, and a lower position shown in which the oven at least partially encloses the objects for heating purposes.

Each of the end walls and side walls of the oven carries upper and lower rows of infrared emitter panels which are electrically energizable. These panels preferably are of the black body emitter type as described in Wells U.S. Pat. No. 3,809,859 issued May 7, 1974, herein incorporated by reference. Said infrared panels provide infrared radiant energy for heating of objects such as that indicated at 22 and may most advantageously have a watt density suitable for heating of polyethylene shrink wrapping material, as in the form of bags placed upon articles of manufacture for shrinking of the same upon lowering of the oven to the position shown in FIG. 2.

Briefly, the oven system senses, as by means of a photocell device or other position sensing or detecting means (not shown) the actual movement of film bag covered articles such as product 22 into a start position. Horizontal drive unit motor 30 then causes movement of tram 28 in the forward direction in synchronism with movement of the object upon the conveyor. At the same time, oven 30 is moved vertically downward to at least partially enclose the object and provide heating thereof. Such heating is continued for a predetermined period as the oven continually moves in synchronism with the object being heated. After the heating period, the oven is raised by vertical drive motor 38 until it reaches its upper position above the now-heated objects such as a shrink-wrapped article of manufacture. The oven is then horizontally moved with accelerated velocity in the reverse direction by horizontal drive unit 30 to the starting position for another cycle.

More specifically, the I-beam rails 25,25' of gantry 23, the length of which may be a matter of choice dependent upon the speed of conveyor 21, etc., are maintained in spaced-apart relationship by transverse frame members 40,41 at opposite ends of the gantry and by a plurality of transverse frame members 40,41 to form a rigid box-like structure which is suspended in any conventional fashion from the ceiling or other structure of a building which houses the new oven system. Adjacent the rearward end of gantry 23 are a further pair of transverse frame members 43,44 of L-shaped cross-section from which are suspended horizontal motor drive unit 30. The latter includes a heavy duty reversible variable spaced DC motor 46 connected to a right angle speed reducing unit 47 having a drive sprocket 48 around which passes a chain 50. A reach of the chain extends to the opposite end frame member 41, passing around an idler sprocket 51 journalled between two supports 52,52' to form bights of the chain at opposite ends of the gantry. Lengths of the chain then extend from the thus-formed bights toward the tram with the ends of the chain then being secured at points 54,55 at opposite ends of tram frame 37. The upper reach of the chain 50 also is guided by idler sprockets 56,57 which are free to turn upon a drive shaft 59 and idler shaft 60, respectively, carried transversely to tram frame 37 by journals 62,62' and 63,63', respectively, at opposite upper ends of the frame. Accordingly, operation of horizontal drive unit 30 by rotation of motor 46 in opposite directions will be seen to move tram 28 in either forward or reverse directions throughout substantially the entire length of gantry 23 for corresponding movement of oven 27 along a predetermined reach of conveyor 21.

Frame 37 of tram 28 is more specifically seen to be of box-like construction, having a spaced-apart pair of upper, horizontal frame members 65,65' which are maintained in parallel relationship by transverse frame members 66,67 at opposite ends of the tram. The tram further includes vertically extending frame members 69,69' and 70,70' carrying journals 62,62' and 63,63'. These frame members are rigidified at their lower ends by horizontal frame members 75,75' at opposite sides of the tram and transverse frame members 76 and 77 at opposite ends. These longitudinal frame members extend somewhat rearwardly of the tram, there being a spaced apart slightly inclined pair of frame members 79,79' interengaging these longitudinal frame members and the upper frame members 65,65' to serve as guides for counterweight 36. Carried upon tram frame 37 is a control box 80 containing the various control circuits manually accessible controls 81 of the system, AC electrical power being provided to such control box 80 by a flexible power line 83. Located proximate the upper end of the tram and carried by frame 37 is a heavy duty step down transformer 84 for providing lower voltage power to motor 46 and to the motor of the vertical drive unit 38.

The latter is seen to be supported from a parallel pair of transverse frame members 86,87 carried between opposite upper longitudinal frame members 65,65'. Vertical drive unit 38 comprises a right angle speed reducing unit 89 which is supported by frame members 86,87 and which is driven by a reversible, variable speed DC motor 90. A gear drive sprocket 91 drives a chain 93 which passes over a sprocket 94 fixed to drive shaft 59. At opposite ends of this shaft are pairs of sprockets 96,96' carrying lengths of chains which carry the opposite ends of oven 27, it being apparent that two of these lengths 97,97' of chain extends forwardly from the drive shaft and pass over guide sprockets 99,99' carried by idler shaft 60 for supporting the forward end of the oven. The oven is guided within tram frame members 69,69' and 70,70' at the lower ends thereof by roller guide assembly as shown in 101,102,102'. Accordingly, it will be seen that motor 90, depending upon the direction of its rotation, will cause oven 27 to be raised or lowered from tram frame 37.

The oven 27 is preferably configured to provide for its side wall portion 31,31' to extend below the surface 104 of conveyor 21, as viewed in FIG. 3, being somewhat lower than the bottom edges of the front and rear wall portions 32,33, but such is the matter of preference only for shrink wrapping purposes, it being apparent that all four walls of the oven may, if desired, terminate at the same level slightly above the surface 104 of the conveyor.

Figure 4:
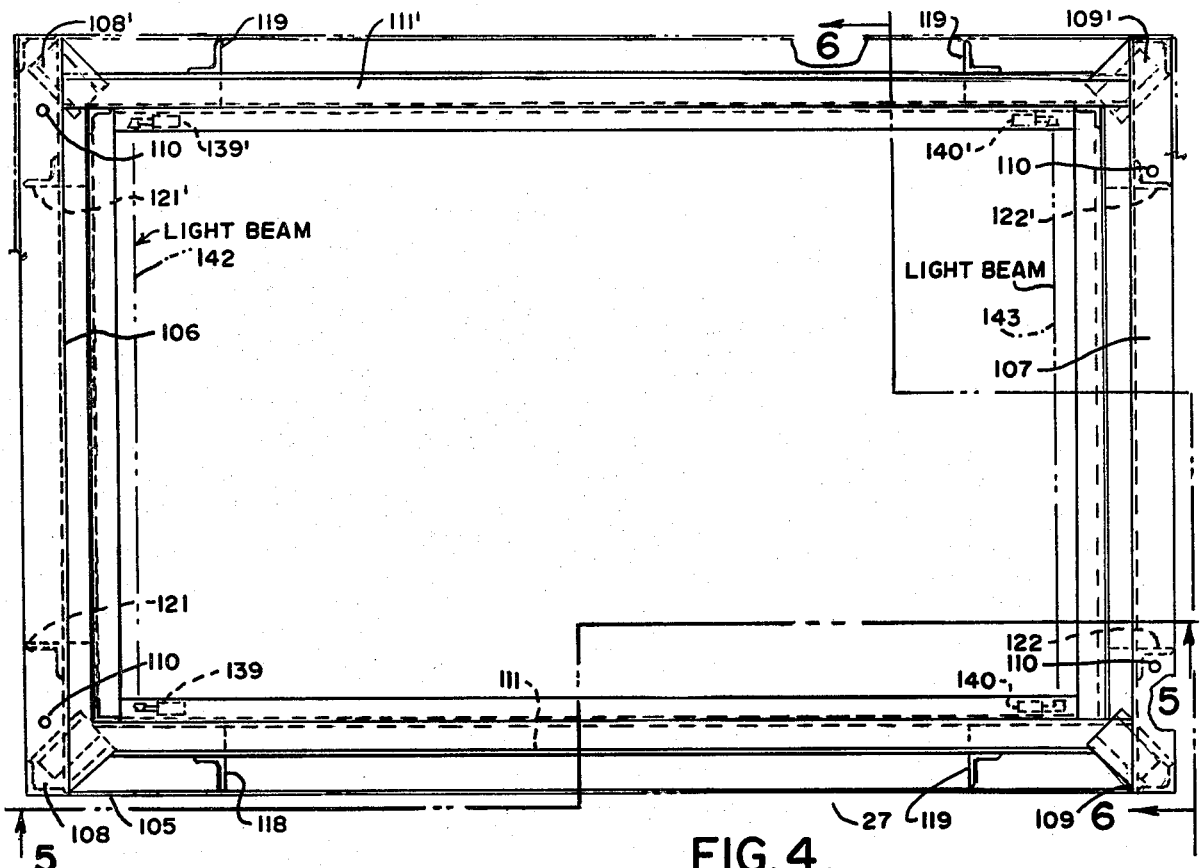
FIG. 4 is a horizontal plan view of a bell oven of the new oven system with the top of the oven and certain panels of the oven removed.
Figure 5:
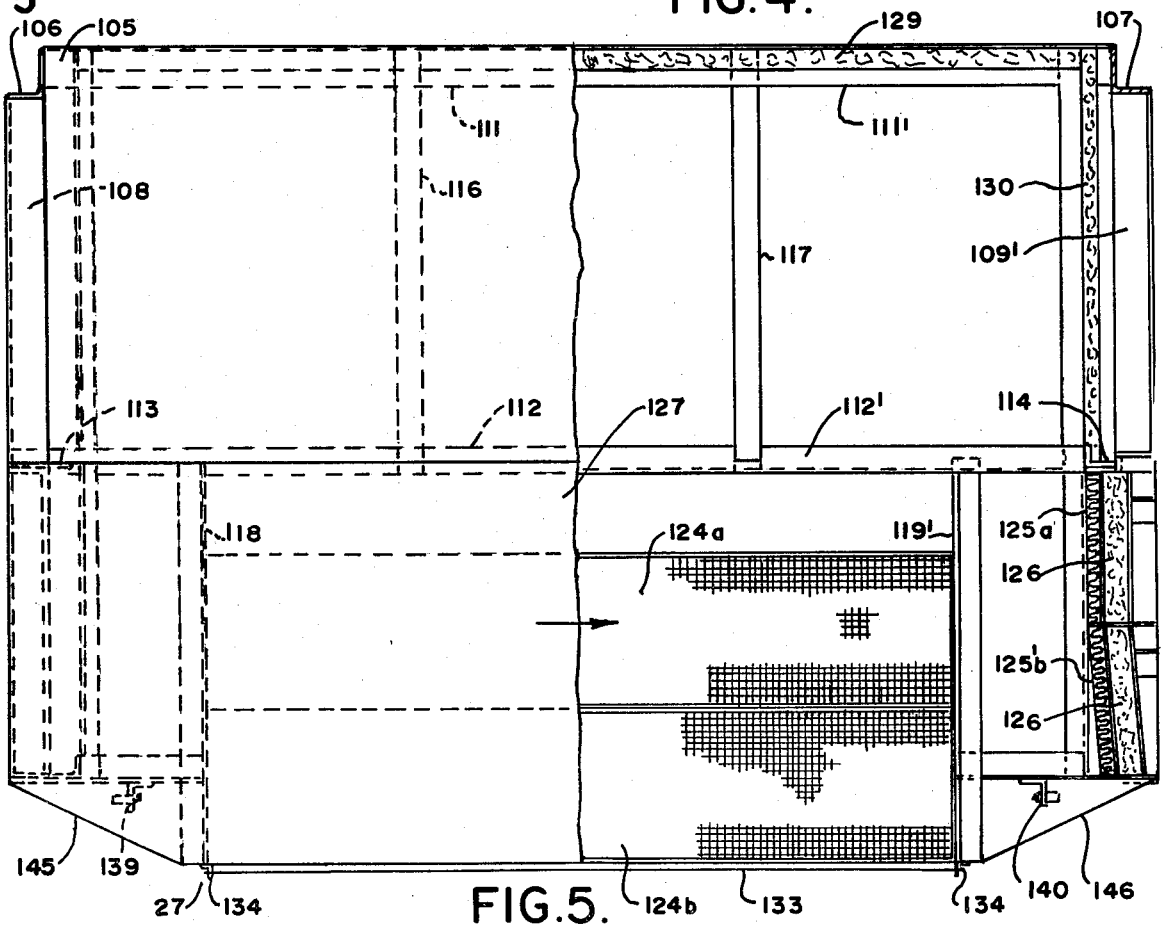
FIG. 5 is a side elevational view of the oven, partly broken away generally along line 5—5 of FIG. 4, to show interior features and portions of the oven in cross-section.
Figure 6:
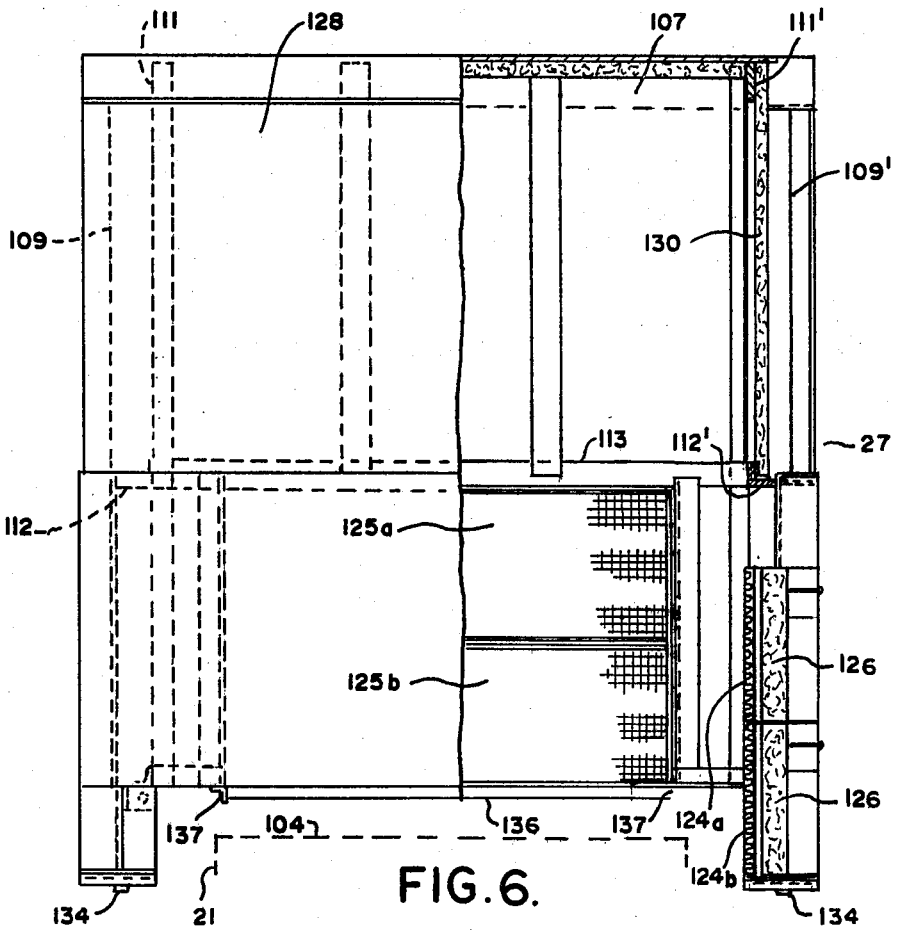
FIG. 6 is an end elevational view of the oven, partly broken away along line 6—6 of FIG. 4, to show interior features and portions of the oven in cross-section.

Referring now to FIGS. 4–6, oven 27 is more specifically seen to be of predominantly rectangular character, being provided with a frame 105 of welded steel comprising relatively massive upper transverse frame members 106,107 from which extend vertically downward frame members 108,108' and 109,109'. Apertures 110 are provided in frame members 106,107 for attachment of the lifting chains. Further upper longitudinal frame members 111,111' interengage these vertical frame members at the upper end and lower longitudinal members 112,112', the latter being interengaged by transverse frame members 113,114 at opposite ends of the oven. This constitutes the fundamental structure of the oven but also provided are additional stiffening members, as shown at 116,117 in FIG. 5, for each of the wall portions. Carried below this primary frame structure and extending downwardly therefrom are angle-section side support members arranged in pairs for each of the walls of the oven, such being designated in the side walls at 118,118' and 119,119' and in the end walls at 121,121' and 122,122', the same serving to support parallel rows of infrared emitter panels of the previously described type upon each wall interiorly of the oven. FIGS. 5 and 6 illustrate the preferred arrangement of heater elements, with upper and lower heater rows 124*a*,124*b* for each of the side walls of the oven and upper and lower rows 125*a*,125*b* for the end walls. Preferably, the end wall lower panels 125*b* are angled in a downward sense to provide increased radiation upon surfaces of objects to be heated as the bell is lowered. The panels in each of the side walls and end walls are backed with fibrous thermal insulation material as shown at 126.

A feature of special note is the placement of the rows 124*a*,124*b* of heating panels in the side walls of the oven at a lower level than the corresponding rows 125*a*,125*b* of heating end wall panels. Such feature provides for heating of objects upon an assembly line at levels slightly below the surface 104 of assembly line 21 (see FIG. 6). This has been found to be of an advantage in shrink wrapping of relatively large objects moving upon conveyor 21 and particularly for the purpose of shrinking portions of heat wrapping bags at the bottom of the object in order to cause the bag to more securely adhere to the object at the lower portions thereof before shrinking of the bag at upper portions, providing a tighter, bottom-secure fit. However, if desired, all of the upper and lower rows of heating elements may be at the same level where the shrink wrapping does not require bottom-accelerated shrinking.

Both the interior and exterior surfaces of the oven are preferably covered by sheet metal material as shown in FIGS. 5 and 6, at 127 on the side walls and 128 on the end walls, the inner wall coverings being omitted in the interest of showing the oven structure. Fibrous thermal insulation material of a nature similar to that shown at 126 may be provided between the inner and outer walls for keeping the outer surface of the oven relatively cool and conserving heat within the oven. Thus, the top of the oven may be insulated as shown at 129 and the side walls and end walls may be insulated as shown at 130.

The lower surfaces of the side walls are provided with a length of bare wire 133 which runs along the entire length of the walls and is spaced a small distance below the lower edge by insulating supports 144 at opposite ends whereby if the lower edge of the oven comes in contact with any object such as, for example, a portion of the body of a worker or an object out of alignment with respect to the oven, the wire 133 will be pressed against the lower surface of the oven, which is conductive metal, to ground wire 133 for the purpose of causing control circuitry of the oven to raise the oven for preventing damage or injury. Similarly, each of the end walls has such a bare conductive wire 136 carried at opposite ends by insulating supports 137.

Carried at the corners of the oven and arranged in pairs at opposite ends are photocell detector and photocell light emitter devices as indicated at 139,139' and 140,140' whereby beams of light 142,143 are transmitted from the light sources to the photocell detectors at each end of the oven for the purpose of detecting the presence of any objects within the light beams, the photocell detector of each such light pair being responsive to interruption of the beams for adjusting the horizontal speed of the oven as more fully explained hereinbelow. As observed in FIG. 5, the oven is provided with angled sheet metal portions 145,146 at opposite ends of the oven which effectively shield the light source-photocell pairs from extraneous light.

Figure 7A:
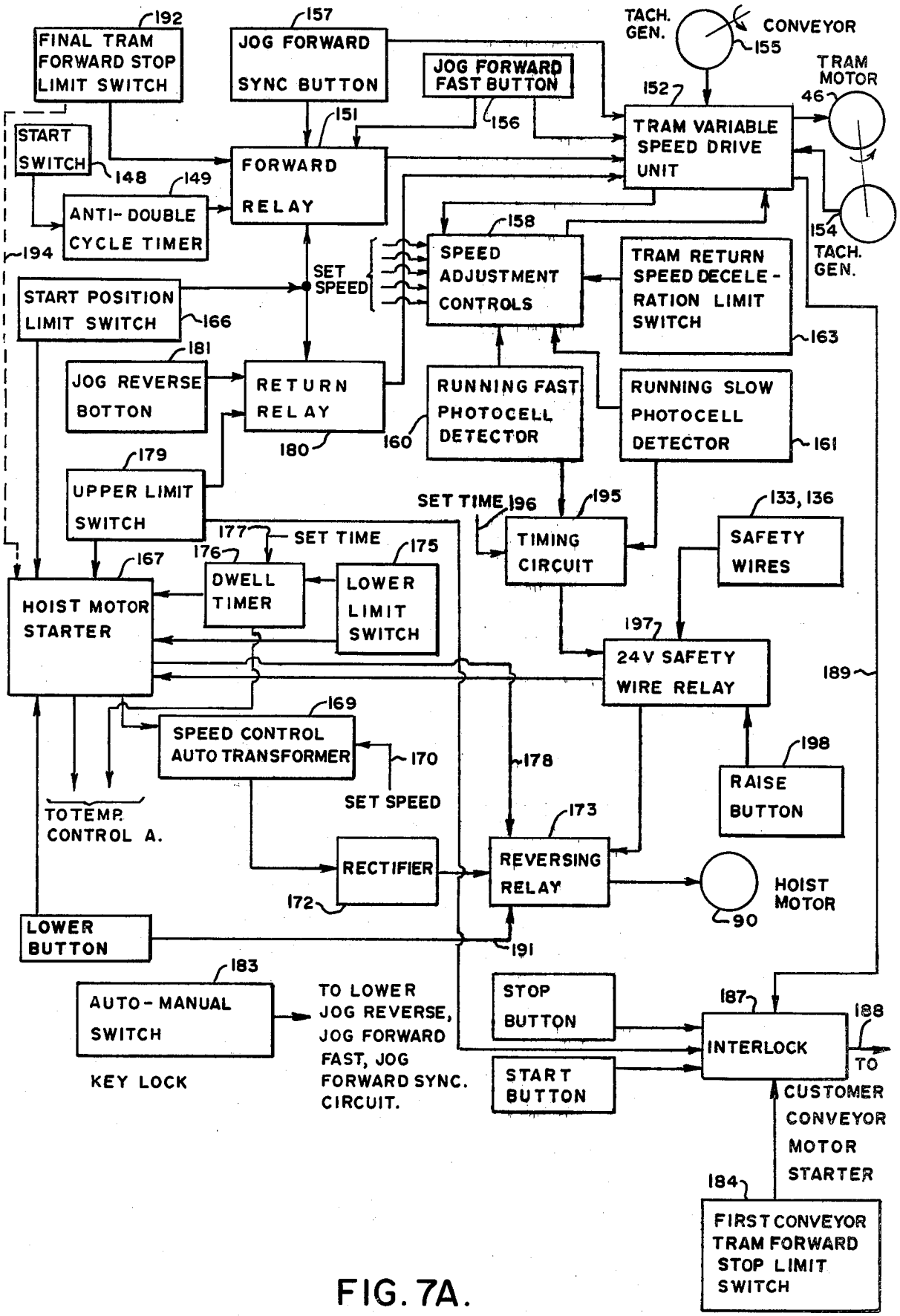
FIG. 7A and 7B together constitute a block diagram of control circuits of the system.
Figure 7B:
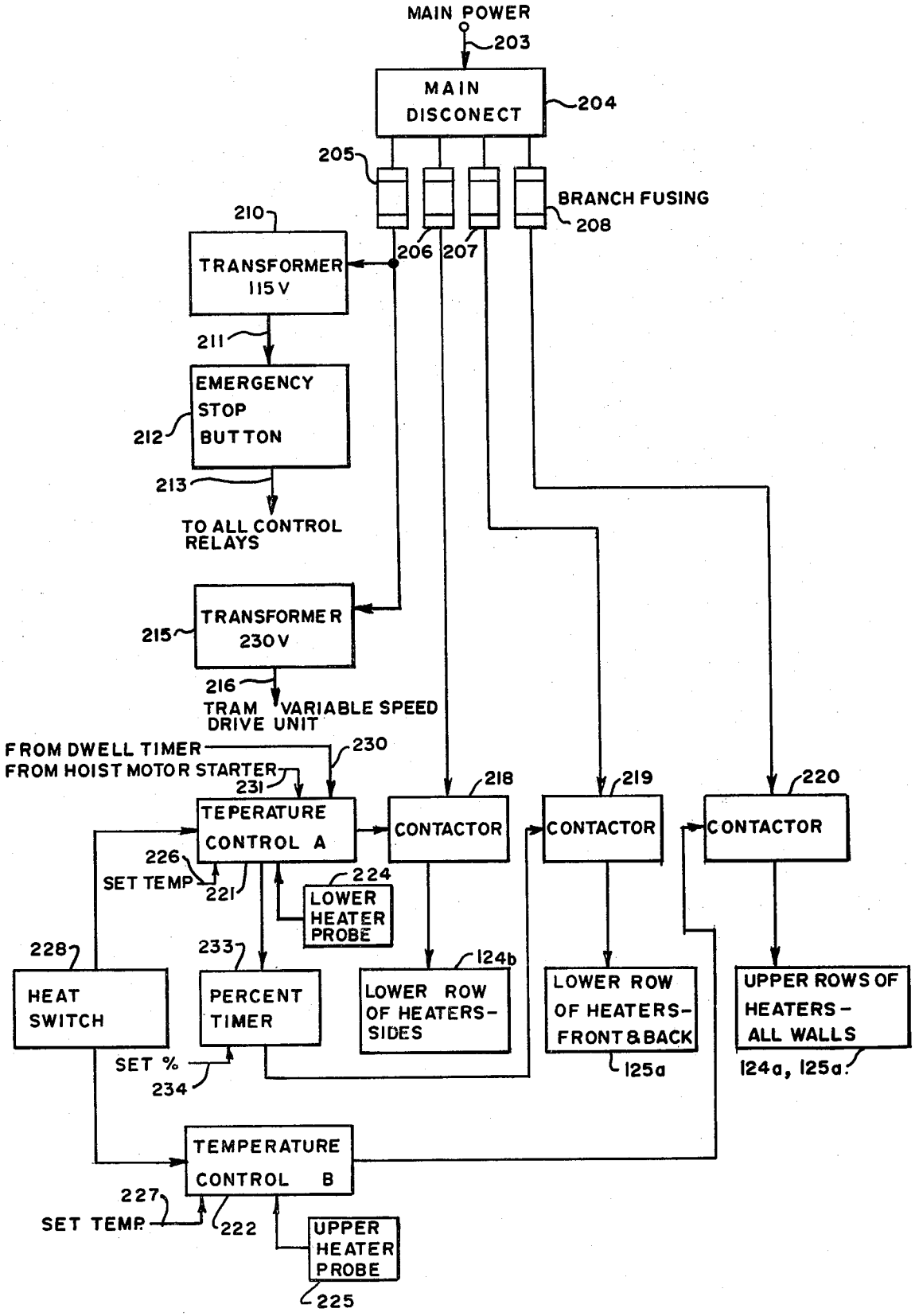

Referring now to FIGS. 7A and 7B, circuitry for controlling operation of the new oven system is illustrated. Such circuitry is enclosed within equipment housing 80 and manual access to the various preselectable or adjustable functions of this circuitry is facilitated by controls 81 on the face of such housing.

Referring then to the circuitry, a start switch 148 may be actuated by any conventional mechanism operable type or by a photocell or other electronic switch or sensor responsive to the movement of an object upon conveyor 21 into a start position at the beginning of the reach of the conveyor over which tram 23 is movable. Switch 148 provides a start signal to an anti-double cycle timer 149 which may be a suitable relay or monostable multivibrator, etc., for providing a single output pulse or start signal regardless of the time of duration of closing of switch 148. This prevents a double cycle if conveyor 21 should stop with the object remaining in the start position and so prevents the stopped object from being heated twice.

Such output pulse is provided to a forward relay 151 adapted for switching electrical power to a variable speed drive unit 152 to control energization of tram drive motor 46. Variable speed drive unit 152 is adapted for providing DC voltage at a preselected average power, as through SCR (silicon controlled rectifier) variable pulse-width switching whenever enabled by forward relay 151. A DC voltage proportional to the rotational speed of motor 46 is provided to drive unit 152 by a tachometer generator 154 suitably driven from the shaft of motor 46. Also provided to variable speed drive unit 152 is a DC tachometer voltage provided by a tachometer generator 155 suitably driven by the motor or drive mechanism of conveyor 21 which DC voltage is proportional to the speed of conveyor 21.

For present purposes, it is preferred that variable speed drive unit 152 be of a commercial type such as available from Cleveland Machine Control in Cleveland, Ohio, and automatically providing phase-controlled triggering of SCR's to maintain the output voltage supplied to motor 46 at average level to cause the motor to operate at a predetermined rotational speed bringing about movement of tram 28 in synchronism with conveyor 21. For such purpose, variable speed drive unit 152 compares the signal provided by tachometer generator 154 with that provided by tachometer generator 155 when the tram is being driven in the forward direction.

A jog forward "sync" button 157 and jog forward fast button 156 are interconnected with variable speed drive unit 152 and with forward relay 151 for manually effecting either fast forward operation of the tram or forward operation of the tram in synchronism with conveyor 21, as desired for maintenance, adjustment, set-up purposes, or the like.

Interconnected with variable speed drive unit 152 are conventional speed adjustment controls 158 for preselecting the various speeds at which variable speed drive unit 152 will operate tram drive motor 26 in either forward or reverse directions. These controls 158 permit also selective adjustment, either for increasing or decreasing the speed of motor 46 when the same is operating in the direction for causing forward movement of the tram, relative to conveyor 21 which also is moving. For this purpose, interconnected with speed adjustment controls 158 are photocell detector circuits 160,161 which are respectively interconnected with the light source-photocell detector pairs 139,139' and 140,140' located at the opposite ends of the oven proximate its lower edges and operation of which is explained hereinbelow. Also interconnected with speed adjustment controls 158 is a tram return speed deceleration limit switch 163 which is carried by the tram for interengagement with a camming surface 165 of the gantry when the tram approaches the start position upon its return from a heating cycle. Speed adjustment controls 158 provide for a predetermined high velocity return of the conveyor, switch 163 being operable to reduce the tram velocity for gentle deceleration as the tram approaches its start position.

Another limit switch 166 is also carried at the upper end of the tram for interengagement with camming surface 164 when the tram is in the start position, switch 166 being interconnected with forward relay 151 for permitting its energization only when the tram is in the start position. Limit switch 166 is also interconnected with a conventional motor starter 167 for hoist motor 90, being operated when the tram begins moving horizontally from the starting position to provide a pulse to hoist motor starter 167 for enabling its operation. Hoist motor starter 167 provides a signal to a conventional autotransformer 169 adapted to be manually adjusted, as indicated at 170, for presetting its output voltage to provide a set speed of hoist motor 90. Such output voltage is provided to a rectifier 172, which rectifies the AC output voltage and supplies the same through a conventional polarity reversing relay 173 to hoist motor 90. The speed of operation of hoist motor 90 may thus be set by selection of the output voltage of autotransformer 169 to provide a desired speed of vertical movement of the oven downward as the tram moves from the starting position substantially in synchronism with conveyor 21. Oven 27 descends as the tram moves horizontally in the forward direction until it reaches a lower position, which is detected by a lower limit switch 175 preferably mounted upon tram 28 for engagement by counterweight 36 when the oven reaches the lower position. Switch 175 is interconnected with hoist motor starter 167 for shutting off voltage provided to autotransformer 169 to terminate operation of hoist motor 90 when the hoist reaches the lower position.

Lower limit switch 175 also preferably has a set of separate contacts interconnected with a dwell timer 176. The latter is a conventional electromechanical or electronic timer adapted to provide a predetermined time interval switch is manually preset as represented at 177, causing the timer to provide a signal to hoist motor 167 for again energizing the hoist motor 90 after timer 176 has timed out. The time set for operation of timer 176 corresponds to the predetermined time of heating of oven 27 of an object upon conveyor 21.

When lower limit switch 175 detects movement of oven 27 to the lower position, it not only causes hoist motor starter 167 to cut off voltage for hoist motor 90 but also causes the hoist motor starter circuit to provide a signal, as indicated by a connection 178, to reversing relay 173 for causing it to provide reverse polarity voltage to hoist motor 90 upon re-energization of the same by the hoist motor starter. Therefore, upon completion of the heating time established by dwell timer 176, hoist motor 167 provides voltage to autotransformer 169 for re-energizing hoist motor 90 to cause oven 27 to begin traveling upward, while tram 28 continues to move synchronously with the object being moved upon conveyor 21.

When oven 27 reaches its upper position, an upper limit switch 179 is actuated. This switch is seen in FIG. 2 to be carried near the top of tram 28 on its forward edge for being contacted by structure of oven 27 upon the same reaching its upper position. When actuated, upper limit switch 179 provides a signal to a return relay 180 for causing it to provide a signal to variable speed drive unit 152. This causes the drive unit to ignore the speed signal supplied to it by speed adjustment controls 158 and to provide energization of tram motor 46 with opposite polarity. This causes tram 28 to move in the reverse direction toward the starting position.

A jog reverse button 181 is also interconnected with return relay 180 and is manually operable to cause jogging movement of the tram in the reverse direction for set-up, maintenance, and adjustment purposes, etc., but ordinarily does not effect normal automatic operation of the system. Manual control over the system is provided also by an auto-manual switch 183 of the key-lock type which is suitably interconnected with the circuits for controlling lowering, jog reverse, jog forward, fast, and jog forward in synchronism functions, etc., whereby authorized personnel may selectively disable or enable the system by means of the key-lock switch to preclude unauthorized personnel from using the manually operable jog switches 157,181 and the like unless switch 183 is in the manual position.

When tram 28, which is traveling in the rearward direction at relatively high velocity, reaches a position causing operation of deceleration limit switch 163, a signal is provided to speed adjustment controls 158 for causing variable speed drive unit 152 to retard the velocity of the tram for gentle deceleration thereof. But, the tram continues to move in the reverse direction until start position limit switch 166 is operated, whereupon a signal is provided by switch 166 to forward relay 151 for terminating energization of tram motor 46 and also to hoist motor starter 167 for enabling operation of the starter upon a further signal from start switch 148 to begin a new cycle. Therefore, hoist motor starter 167 is made ready to provide re-energization of hoist motor 90 to begin lowering oven 27 when the tram again begins moving forward, as signalled by start position limit switch 166.

The previous description assumes the normal operation of the system to provide a complete heating cycle with the oven lowering to heating position, traversing horizontally in synchronism with the object moving on conveyor 21 and with the oven rising to its upper limit for movement horizontally in the reverse direction all occurring well within the time which otherwise would be required for the oven to traverse its permissible maximum horizontal distance, as established by the length of rails 25,25'. To allow a full heating cycle to take place if adequate horizontal traverse of oven 27 should be unavailable, a first conveyor tram forward stop limit switch 184 is provided upon tram 28 (see FIG. 2) for being tripped by a camming surface 185 carried upon rail 25 proximate the forward end of the gantry. Such surface 185 causes actuation of stop limit switch 184 if the tram approaches the end of the gantry during forward movement. Switch 184 is interconnected with an interlock circuit 187 to provide control by means of an interlocking circuit connection 188 with the motor starter of conveyor 21. Variable speed drive unit 152 is also interconnected, as indicated at 189, with interlock circuit 187 whereby, upon actuation of switch 184, the connection 188 with the motor starter of conveyor 21 will cause movement of the conveyor to retard and ultimately stop. This permits heating of the object upon conveyor 21 to continue until dwell timer 176 times out. When the predetermined heating period established by timer 176 is completed, upper limit switch 179, through interconnection as indicated at 191, permits interlock circuit 187 via connection 188 to re-energize the motor starter of conveyor 21 for permitting resumption of normal conveyor movement. Such operation is not ordinarily required and could be expected to occur only under unusual circumstances such as an abnormal increase in the speed of the conveyor 21.

Yet another safety feature of the system involves the provision of a final tram forward stop limit switch 192 which is also located upon the tram structure rearwardly of switch 184 but also adapted for being tripped by camming surface 185. Switch 192 will not be tripped until tram 28 approaches the ends of rails 25,25', i.e., until it approaches the end of the conveyor reach over which the oven is intended to travel. If the predetermined heating period is not yet completed as the tram reaches the point of tripping of switch 192, which is interconnected with forward relay 151, switch 192 causes tram variable speed drive unit 152 to cease energization of tram motor 46, halting the tram. If desired, such switch 184 may also be utilized in conjunction with hoist motor starter 167 to cause the oven to move upward upon the tram reaching a position causing operation of switch 184, by means of an optional functional interconnection 194 between tram stop limit switch 192 and hoist motor starter 167. The oven will then move to its upper limit and be returned to the start position. Alternatively, the oven may be permitted to remain in the lower position until the predetermined heating interval established by dwell timer 176 is completed, only then permitting hoist motor starter 176 to cause the oven to be raised. In either event, the oven is ultimately returned to starting position.

During forward movement of the oven in synchronism with conveyor 21, but assuming the adjustment of speed adjustment controls 158 in a proper fashion, the oven normally will remain approximately centered about the object enclosed therein being heated by it during forward movement. However, should there be a slight variance in the speed of the oven with respect to objects moving upon conveyor 21, as through voltage errors or other timing or misalignment deficiencies, photocell detector circuits 160,161 are operative to detect either that the oven is running forwardly too fast or too slow, respectively, such circuits being otherwise inoperative. But if the oven should be moving too fast, the object within the oven will interrupt light beam 142 to which photocell detector circuit 160 is responsive, causing speed adjustment controls 158 to produce a variation in the output level of variable speed drive unit 152 for slightly slowing tram motor 46. Similarly, movement of the oven too slowly will cause interruption of light beam 143 to which photocell detector circuit 161 is responsive, providing a signal to the speed adjustment controls for slightly speeding up the operation of the tram motor.

The running fast and running slow photocell detector circuits 160,161 are interconnected with a timing circuit 195. The latter is of electromechanical or electronic nature having a control representatively indicated at 196 for establishing a predetermined time delay, which may be a fraction of a second up to perhaps ten seconds, after which timing circuit 195 will provide a signal to a safety wire relay 197 which is seen to be interconnected with reversing relay 173. If either of light beams 142,143 remains interrupted for the period in excess of that established by timing circuit 195, the latter causes relay 197 to provide a signal for energization of reversing relay 173, causing hoist motor 90 to raise the oven. Timing circuit 195 is adapted also to respond to the presence of signals concurrently from both of the photocell detector circuits 160,161 for causing, via safety wire relay 197, the oven motor to be energized. Hence, the oven is raised if both light beams 142,143 are concurrently interrupted, as might occur by an improper double load below the oven.

Also interconnected with safety wire relay 197 are the safety wires 133,136 which extend along the lower edges of the oven. Such wires are energized with a relative low voltage, e.g., 24 VAC, to operate relay 197 upon contacting the metal surfaces of the oven. Therefore, if any object comes in contact with the lower edge of the oven, causing safety wires 133,136 to make electrical contact with the oven surfaces, safety wire relay 197 causes reversing relay 173 to provide opposite polarity voltage to hoist motor 90 for raising the oven.

A manual operable raise button 198 is also interconnected with safety wire relay 173 and is positioned upon the front surface of control 80. A stop button 200 and start button 201 provide additional manually operable pushbutton available at the front panel of control box 80 for stopping or starting conveyor 21, such buttons being interconnected with interlock circuit 187 as shown.

Referring to FIG. 7B, further circuitry of the system, including the heating control features for controlling energization of the infrared heating panels, is illustrated. Main power, such as three-phase 460 volt utility service is supplied, as indicated at 203, to a main disconnect switch or contactor 204 having interconnected therewith a plurality of branch fuses 205,206,207, and 208 for supplying various circuits. To simplify the drawing, only a single phase and single fuse for each phase is shown, but it will be understood that in reality each fuse 205,206, 207, and 208 represents a three-phase power connection to the various circuits.

Power is provided through fuse 205 to a stepdown transformer 210 having a secondary winding which provides power, via a connection 211, to an emergency stop button 212 and thence through various circuit interconnections symbolically indicated at 213 to the various control relays of FIG. 7A. Power through fuse 205 is also provided to a stepdown transformer 215 providing power by means of its secondary, e.g., at 230 volts to tram variable speed drive unit 152.

Each of branch fuses 206,207, and 208 supplies power, via respective magnetic contactors 218,219 and 220, to respective sets of heaters of the oven, as arranged in rows **124*a*, 124*b* along the side walls, and rows 125*a*, 125*b* along front and rear walls of the oven. Thus, contactor 218 provides three-phase power, when the contactor is energized, to the lower row of heaters 124*b* at each side of the oven (FIG. 5), contactor 219 when energized provides power to the lower row of heaters 125*b* at the front and back walls (FIG. 6), while contactor 220 when energized provides power to the upper rows of heaters 124*a*, 125*a*** on both side walls as well as the front and back walls.

Separate temperature control circuit 221,222 (respectively designated temperature control A and temperature control B) control the energization of contractors 218,220, respectively. Interconnected with these two controls are respective temperature probes 224,225 which preferably may be of thermocouple, thermistor, or other solid state type probes but which, in any event, are associated with the lower row of heater panels **124*b* and upper rows of heater panels 124*a*, 125*b* for directly sensing the temperature thereof. Temperature control circuits 221,222 are preferably of the time proportioning type commercially available adapted for switching on and off the electrical heater elements interconnected therewith, by means of contactors 218,220, on a time proportioning basis with a cycling interval of preferably a few seconds as a function of the temperature sensed by the respective probe 224,225, thereby maintaining the heater panels at predetermined temperatures which are manually preselected by controls of the usual type as indicated at 226,227**.

Both of temperature control circuits 226,227 are adapted to be selectively enabled or disabled by operation of a heat switch 229 which is grouped with controls 81 upon control box 80, whereby manual control over the heating of the system is provided. However, for the purposes of automatic operation of the heating, it should be observed that circuit interconnections are made, as indicated at 230,231 with dwell timer 177 and with hoist motor starter 167, respectively, for the purpose of causing temperature control circuit 221 to provide continuous energization of contactor 218 in response to signals provided either by hoist motor starter 167 or dwell timer 176.

Accordingly, when hoist motor starter 167 is energized for causing operation of hoist motor 90 to lower oven 27 to the heating position upon the conveyor, temperature control circuit 221 causes contactor 218 to continuously energize the heating elements **124*b* at the lower row upon the sides of the oven. Also, when the oven reaches its fully lowered position, dwell timer 176 then takes over the function of signalling temperature control circuit 221** to continue full energization of the lower row of heating elements at the sides of the oven, so long as the timer continues to time out. Therefore, it is understood that the lower row of heaters at the sides of the conveyor is continuously energized throughout the heating interval whereby higher heating occurs at the sides of the object upon the conveyor as it is being heated. This is an advantage for heat shrink purposes as the material adjacent to sides of the conveyor will be shrunk at a greater rate than elsewhere causing the shrink wrap material to be firmly seated around the lower portions of the product to which it is applied.

Interconnected with temperature control circuit 221 is a timer circuit 233 constituted by a percent proportioning timer of a commercial electromechanical or electronic type adapted to cause the output thereof to be on only a selected percent of the time in which the input signal is provided in accordance with a preset percentage which may be selectively adjusted as indicated at 234. Said percent timer is interconnected with contactor 219 whereby the lower row of heaters **125*a* at the front and back walls of the oven are energized only for given percentages of the time provided for energization of the lower row of heating elements 124*b* at the sides of the oven. For example, a percentage ratio of 80–90% may be selected whereby the amount of heat applied to the ends of the product would be only 80–90% of the heat applied to the sides of the object. Such figures are merely representative of one particularly preferred form of use of the system for shrink wrapping purposes and it is within the purview of the invention to provide either for constant temperature operation of the heating elements in any of the rows or full energization of any or all for the given heating interval, as desired for a given shrink wrap or other heating purpose. But, it is preferred for shrink wrapping purposes to maintain heating elements at an idling temperature whereby the temperatures in the oven are at a standby level but to fully energize at least the lower row of heaters at the sides of the oven upon shrink wrapping of an article upon conveyor 21**. Such extent of energization, selection of the actual temperatures to be maintained, and so forth, are matters selectively to be determined for a given heating application of the new traveling oven system of the invention.

Figure 8:
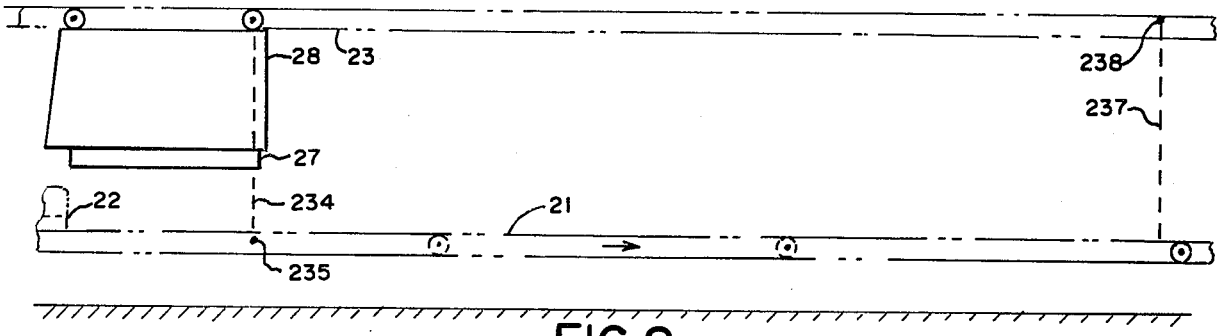
FIGS. 8–12 are a series of pictorial illustrations showing various steps in the sequence of operation of the oven system in conjunction with an extrinsic conveyor system.

FIGS. 8–12 illustrate the operation of the new oven system by showing various steps in the sequence which occurs during its use. FIG. 8 reveals the position of over 27 over a starting position represented by edge alignment of slightly downstream from a line 234 which is perpendicular to conveyor 21 and in alignment with a suitable detector 235, which may comprise simply a photocell device of conventional type for detecting movement by conveyor 21 of an object 22 on the conveyor into position for being heated by oven 27. Thus, the start position is deemed to mark the beginning of a reach of conveyor 21 over which gantry 23 extends, the tram 28 carrying oven 27 being horizontally traversable over gantry 23 through the entire length of this conveyor reach. The end of this reach is marked by a line 237 perpendicular to conveyor 21 and aligned with a point 238 defined by the position of the forward edge of the oven when switch 192 contacts camming surface 195 (see FIG. 2). However, during normal operation, the forward edge of oven 27 does not reach such point.

Figure 9:
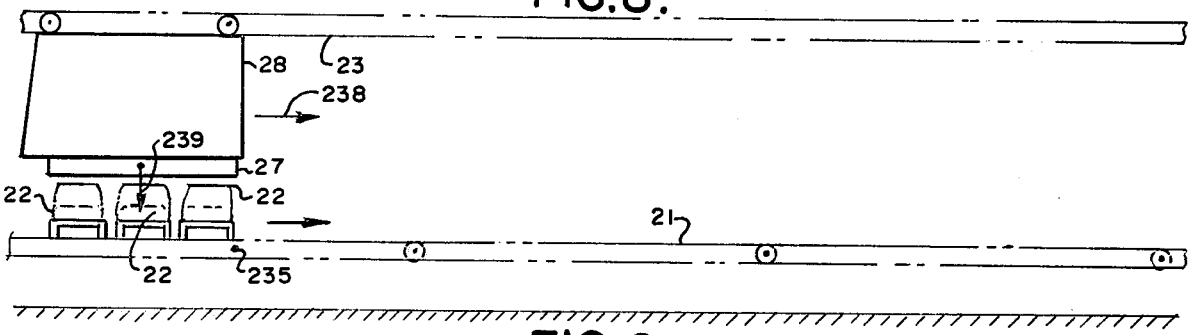

During normal operation, movement by conveyor 21 of an object 22 into alignment with photocell detector 235 is represented in FIG. 9, wherein such object is deemed to comprise automobile seat assemblies which are covered with a bag of polyethylene sheet material of the type adapted to shrink for wrapping purposes when heated by oven 27. When these articles move into position detected by photodetector 235, the horizontal drive of the system is energized in the previously described manner to begin movement in a forward direction, as indicated by an arrow 238 in synchronism with the moving object 22, regardless of any variations in the speed of conveyor 21, or even stopping of the conveyor.

Figure 10:
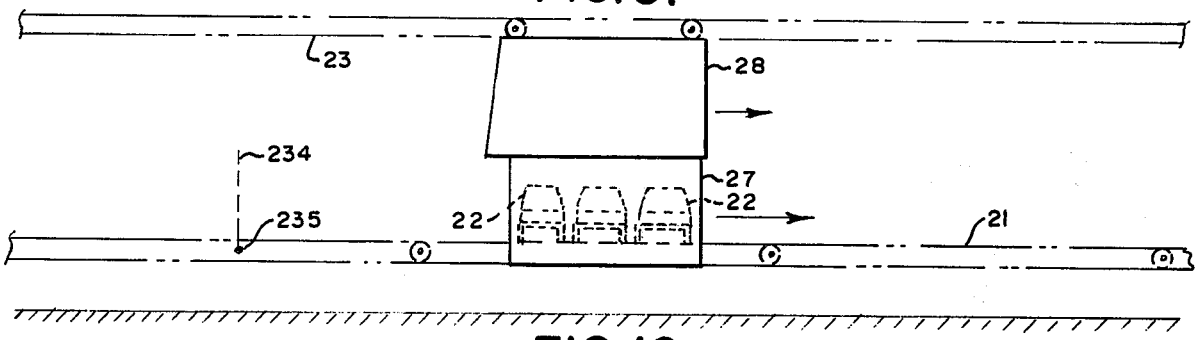
Figure 11:
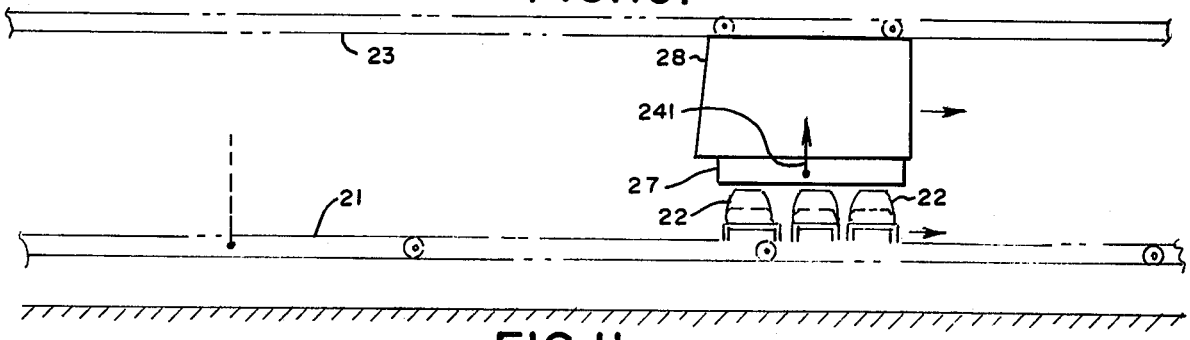
Figure 12:
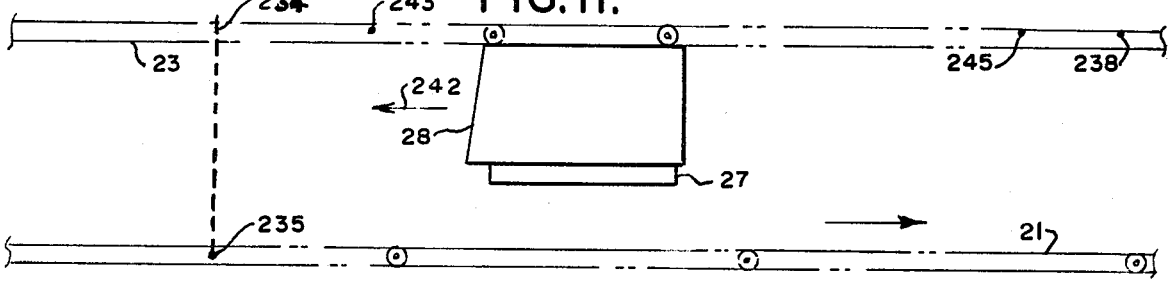

When the oven and tram begin such horizontal movement, oven 27 is moved downward by the vertical drive arrangement of the system, such downward movement being represented by an arrow 239 and continuing until the objects, i.e., the film covered heat assemblies, are partially enclosed by oven 27 as shown in FIG. 10, wherein it is apparent that tram 28 and oven 27 carried by the tram are now moved through a substantial horizontal distance from starting line 234.

As previously understood, the infrared emitter panels which are associated with the interior of the side and end wall portions of oven 27 are provided with increased energization when oven 27 begins moving downwardly and a predetermined heating period is initiated upon the oven reaching its most downward position as shown in FIG. 10. Heating continues until timer 176 has timed out whereupon oven 27 is moved upward as indicated by an arrow 241 in FIG. 10. The oven continues to be moved upward while it is moved forward by movement of tram 28 along gantry 23 in the forward direction. When the oven reaches its fully raised position (with the lower edge of the oven well clear of all objects upon conveyor 21), tram 28 reverses direction and begins moving with accelerated velocity, as indicated by a longer arrow 242 in FIG. 12, in the reverse direction. Typical vertical velocities of the oven are about 25 fpm (feet per minute). Forward synchronous velocity may typically be about 8 fpm but the return velocity may typically be as high as 80 fpm.

When the oven as it moves in the reverse direction reaches a point 243 represented by the engagement of camming surface 164 by switch 163, the horizontal drive motor is slowed to provide gentle deceleration of the unit from the accelerated velocity so that it approaches the starting position 234 with retarded velocity. Movement, therefore, continues at such lower velocity until the oven reaches a point 243 which is represented by the interengagement of camming surface 164 by switch 166, whereupon all further horizontal movement of the oven is terminated. The oven and tram, therefore, remain in this position until a further object reaches the starting position, as detected by photodetector means 235.

It may be observed, however, that if the oven should reach a point 245 at which camming surface 185 would be contacted by switch 184, a signal is provided in the manner previously described to the drive mechanism control for conveyor 21 to retard its movement, bringing the conveyor to a stop, for permitting the heating period to be completed. If for some reason, such as the failure of components of conveyor 21 or other control apparatus of the oven system, movement of tram 28 and oven 27 carried by it should continue past the point 245 to point 238 marking the end of permissible travel over the reach of conveyor 21, such contingency is detected by the engagement of camming surface 185 by switch 192, causing horizontal forward movement to be terminated and instead resulting in a signal for halting the oven and/or raising it to its upper position with subsequent movement of the tram in the reverse direction to return the oven to the starting position.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. An oven system adapted for synchronous use with an extrinsic conveyor, said system providing automatic heating of objects successively being conveyed by said conveyor and comprising an oven having means defining a housing including side wall portions, front and rear wall portions, a top wall, and being open at the lower end, heating elements within said oven associated with predetermined ones of said wall portions, means for carrying said oven above an extrinsic conveyor for vertical movement with respect to said conveyor and for horizontal movement in forward and reverse directions along a reach of said conveyor, vertical drive means for vertically moving said oven up and down between an upper position within the lower end of said oven above objects of said conveyor and a lower position with said oven at least partially enclosing said objects on said conveyor for heating thereof by said heating elements, horizontal drive means for horizontally moving said oven in said forward and reverse directions, and control means for causing said horizontal drive means to move said oven forward in synchronism with movement of said objects upon said conveyor while causing said vertical drive means to move said oven to said lower position for heating of said objects and thereafter to move said oven to said upper position, and subsequently causing said horizontal drive means to move said oven in said reverse direction to return said oven for heating of further items upon said conveyor.

2. An oven system as defined in claim 1, said control means further comprising means for causing said oven when moving in said reverse direction to return to a starting position proximate the beginning of said conveyor reach.

3. An oven system as defined in claim 2, said control means further comprising means for causing said vertical drive means to move said oven downward for heating of objects upon said conveyor only upon objects moving into alignment with said starting position.

4. An oven system as defined in claim 3, said control means further comprising means carried at the lower end of said oven for causing said vertical drive means to move said oven upward in response to objects contacting the lower end of said oven.

5. An oven system as defined in claim 4, said control means characterized by the last said means comprising safety wires carried at the lower edges of said side wall, front wall, and rear wall portions of said oven, and means responsive to said safety wires being contacted to cause energization of said vertical drive means to move said oven upward.

6. An oven system as defined in claim 2, said control means further comprising position comparing means for comparing the position of said oven with respect to an object upon said conveyor being heated within said oven, and speed adjusting means, responsive to said comparing means, for adjusting said horizontal drive means to vary the speed of horizontal movement of said oven in a sense for causing relative adjustment of the position of said oven, while moving, with respect to such object being heated within said oven.

7. An oven system as defined in claim 6, said control means characterized by said position comparing means comprising photodetector means carried at the lower end of said oven responsive to the position of an object upon said conveyor relative to the lower end of said oven.

8. An oven system as defined in claim 7 and further characterized by said position comparing means comprising a first photodetector means at a forward end of said oven and a second photodetector means for the rearward end of said oven for detecting proximity either to the forward or rearward ends of said oven of an object upon said conveyor, said speed adjusting means being responsive to detection of an object either by said first or second photodetector means for either slowing or increasing, respectively, the speed of forward horizontal movement of said oven.

9. An oven system as defined in claim 8 and further characterized by means responsive to detection by both said first and second photodetector means to cause energization of said vertical drive means to move said oven upward.

10. An oven system as defined in claim 1 and further characterized by said heating elements being electrically energized infrared radiant heating panels.

11. An oven system as defined in claim 1 and further comprising heater control means for controlling said heating elements to maintain a predetermined temperature thereof.

12. An oven system as defined in claim 11 and further comprising means for causing said heater control means to provide increased temperature heating by at least predetermined ones of said heating elements when said oven is moved to said lower position.

13. An oven system as defined in claim 12 and further characterized by said means for causing increased temperature heating by predetermined heating elements comprising means responsive to operation of said vertical drive means.

14. An oven system as defined in claim 13, said control means further comprising timing means for causing said oven to remain in said lower position for a predetermined period while moving in synchronism with said conveyor for heating of objects within said oven for said predetermined period, said means for causing increased temperature heating by predetermined heating elements being responsive also to said timing means.

15. An oven system as defined in claim 2, said control means further comprising means for causing said oven when moving horizontally in said reverse direction to return to said starting position with accelerated velocity.

16. An oven system as defined in claim 15, said control means further comprising means for causing gentle deceleration of said oven from said accelerated velocity upon said oven approaching said starting position.

17. An oven system as defined in claim 1, said control means further comprising timing means for causing said oven to remain in said lower position for a predetermined heating period while said oven is moving in synchronism with said conveyor for heating of an object within said oven in synchronism with movement of said object.

18. An oven system as defined in claim 17 and further comprising means for causing movement of said conveyor to be retarded upon said oven reaching a predetermined point along said conveyor reach during forward horizontal movement of said oven if said predetermined heating period is incomplete upon said oven reaching said predetermined point.

19. An oven system as defined in claim 18 and further comprising means for causing said horizontal drive means to prevent further forward horizontal movement of said oven upon said oven approaching a point proximate the end of said conveyor reach.

20. An oven system as defined in claim 19 and further characterized by said means for causing said horizontal drive means to prevent further forward horizontal movement of said oven being operative to cause said horizontal drive means to return said oven to said starting position.

21. An oven system as defined in claim 1, said means for carrying said oven above said conveyor comprising a gantry, a tram movable horizontally in forward and reverse directions along said gantry, said tram having a frame, said oven being supported by said frame for vertical movement with respect thereto.

22. An oven system as defined in claim 21, said gantry comprising a parallel, spaced apart pair of rails, said tram including a plurality of rollers for providing rolling interengagement of said rails for supporting said tram below said rails.

23. An oven system as defined in claim 22, said tram frame comprising a plurality of vertical members exteriorally of wall portions of said oven, said means for carrying said oven further comprising rollers for providing rolling interengagement between said oven and said vertical members.

24. An oven system as defined in claim 21, said horizontal drive means comprising a belt having a reach extending between opposite ends of said gantry, means forming bights of said belt at the opposite ends of said reach, ends of said belt extending from the respective bights to said tram and secured to said tram, and motor driven means operatively engaging said belt for pulling said belt in one direction or the other to move said tram in forward or reverse directions for corresponding movement of said oven.

25. An oven system as defined in claim 21 and further characterized by said belt comprising a chain belt, said motor driven means comprising a reversible, variable speed DC motor, speed reducer connected to said motor and a sprocket driven by said speed reducer by engaging said chain.

26. An oven system as defined in claim 21, further vertical drive means comprising at least one chain belt, means carried by said tram forming a bight of said chain belt, a first reach of said chain belt extending from said bight and extending to said oven and being secured thereto for supporting said oven by said chain belt, and motor driven means operatively engaging a second reach of said chain belt extending from said bight for lengthening and shortening said first reach for lifting and lowering said oven to move said oven up and down.

27. An oven system as defined in claim 26 and further characterized by said second reach of said chain belt being secured to a counterweight for balancing the weight of said oven, said bight forming means comprising a sprocket, said motor means comprising a reversible, variable speed DC motor, and a speed reducer connected to said motor for driving said sprocket.

28. An oven system as defined in claim 27 and further characterized by said vertical drive means comprising a pair of shafts journalled at opposite ends to said tram, a plurality of sprockets carried upon said shafts, a plurality of chain belts extending from said counterweight over said sprockets to opposite ends of said oven, at least one of said shafts being driven by said motor via said speed reducer.

29. An oven system as defined in claim 1, said heating elements comprising rows of infrared emitter panels along the interior surfaces of each of said side wall portions and front and rear wall portions.

30. An oven system as defined in claim 29, said oven being of generally rectangular character, said side wall portions having lower edges extending below lower edges of said front and rear wall portions.

31. An oven system as defined in claim 30, said infrared emitter panels being arranged in rows proximate the lower edges of each of said wall portions, infrared emitter panels of said side wall portions being in rows which are lower than rows of said infrared emitter panels of said front and rear wall portions.

32. An oven system providing automatic synchronous heating of objects moved by an extrinsic conveyor and comprising an oven having a housing open at the lower end, heating elements within said oven, means for carrying said oven above an extrinsic conveyor for vertical movement with respect to said conveyor between upper and lower positions and for horizontal movement in forward and reverse directions along a reach of said conveyor, said oven at least partially enclosing said objects on said conveyor for heating thereof when in said lower position, means for moving said oven to said lower position for heating of said objects, means for moving said oven forward from a starting position in synchronism with movement of said objects upon said conveyor while heating of said objects occurs, means for moving said oven to said upper position after said heating, and means for returning said oven after said heating to said starting position for heating of further items upon said conveyor.

* * * * *